US005588808A

United States Patent [19]

De Santis

[11] Patent Number: 5,588,808

[45] Date of Patent: Dec. 31, 1996

[54] PUMP PRESSURE MULTIPLIER

[75] Inventor: Gerard J. De Santis, Battle Creek, Mich.

[73] Assignee: Hytech Pumps International, Inc., Bedford, Mich.

[21] Appl. No.: 352,316

[22] Filed: Dec. 8, 1994

[51] Int. Cl.[6] ..... F04B 35/02

[52] U.S. Cl. ..... 417/225; 417/397

[58] Field of Search ..... 417/225, 248, 417/397

[56] References Cited

U.S. PATENT DOCUMENTS

| | | | |
|---|---|---|---|
| 3,234,883 | 2/1966 | Douglas et al. | 417/397 |
| 3,363,575 | 1/1968 | Potts | 417/397 |
| 3,811,795 | 5/1974 | Olsen | 417/397 |
| 4,601,642 | 7/1986 | Andrews | 417/225 |
| 4,735,051 | 4/1988 | Bittel et al. | 417/225 |

*Primary Examiner*—Timothy Thorpe
*Assistant Examiner*—William Wicker
*Attorney, Agent, or Firm*—Flynn, Thiel, Boutell & Tanis, P.C.

[57] ABSTRACT

A device for elevating a pressure acting on a liquid including a liquid pressure elevating mechanism for receiving liquid under a first positive pressure and at a selected volume of liquid per unit of time flow rate from a liquid source at an inlet port and supplying the liquid under a second positive pressure substantially greater than the first pressure and at the selected volume of liquid per unit of time flow rate to an outlet port and a liquid utilizing load connected thereto. The second pressure is sufficiently high enough to cause the liquid to become substantially compressed to thereby result in the second pressure to want to vary during intervals of time that the liquid is being compressed. A control device is provided for accommodating the compressibility of the liquid so as to maintain a substantially constant second pressure.

9 Claims, 3 Drawing Sheets

PUMP PRESSURE MULTIPLIER

FIELD OF THE INVENTION

This invention relates to a device for elevating a pressure acting on a liquid and, more particularly, relates to a device for accommodating the compressibility of a liquid occurring at very high pressures and without the need for an accumulator in a liquid circuit.

BACKGROUND OF THE INVENTION

This invention arose out of a desire to provide high liquid pressure operation without the need to incorporate accumulator circuitry in the liquid circuit. It is known, for example, that the volume of liquid, namely, water at 10,000 psi, will be reduced in volume by approximately 2.7% from the same quantity of water at atmospheric pressure. Similarly, it is known that the same quantity of liquid (water) at atmospheric pressure will be compressed by approximately 7.5% at 36,000 psi. Thus, in operations where the pressure on a liquid is elevated to substantially high pressures, such as in the range of 30,000 psi to 40,000 psi, and assuming that a liquid utilizing load is connected in circuit with the high pressure liquid supply, the pressure on the liquid will be substantially reduced at a time when the pressure on the liquid is building, but yet liquid is exiting the system to the liquid utilizing load. One of ordinary skill in the art has, in the past, utilized accumulator circuitry for supplying an adequate amount of liquid at a high pressure in order to maintain the pressure at the outlet of the liquid distribution system at a fairly constant level. Accumulators subjected to a pressure of between 30,000 psi and 40,000 psi are expensive components in any liquid system and their elimination from any circuit would be financially beneficial.

Accordingly, it is an object of the invention to provide a device for elevating a pressure acting on a liquid to a substantially high level and without incorporating an accumulator within the liquid circuit.

It is a further object of the invention to provide a device for elevating a pressure acting on a liquid, as aforesaid, wherein at an inlet to the system, a liquid is supplied at a first positive pressure and extracting from the system a liquid at a second positive pressure substantially greater than the first pressure resulting in a liquid compressibility factor at the inlet that is much less than the liquid compressibility factor at the outlet of the liquid system so that a control device accommodates the differential in compressibility of the liquid without resorting to the use of a liquid accumulator circuit in order to maintain, at an established throughput, the second pressure substantially constant.

It is a further object of the invention to provide a device for elevating a pressure acting on a liquid, as aforesaid, wherein at least a pair of elongated, hollow, cylindrical housings are provided each having a plunger reciprocally movable therein, the plungers being freely movable between the ends of the cylinder housings in response to the introduction of pressurized liquid into a selected end of each thereof to facilitate a driving of the plungers toward the other end.

It is a further object of the invention to provide a device for elevating a pressure acting on a liquid, as aforesaid, wherein a control device is provided for effecting a pressure imbalance on one side of the plunger in a second cylinder housing before the plunger in the first cylinder housing arrives at an end of a stroke path therefor and whereat the flow rate from the second cylinder housing begins to diminish so that a flow rate caused by a beginning stroke path of the plunger in the second cylinder housing will supply a flow rate balancing amount of liquid to a common outlet from the liquid system at substantially the same second pressure so as to maintain substantially constant the second pressure at the common outlet from both the first and second cylinder housings.

It is a further object of the invention to provide a device for elevating a pressure acting on a liquid, as aforesaid, wherein the ratio between the pressures at the inlet to the liquid distribution system and the liquid exiting the outlet from the liquid distribution system is 1 to 4.

It is a further object of the invention to provide a device for elevating a pressure acting on a liquid, as aforesaid, wherein a plurality of valves are sequentially activated with a portion of the operative cycle of one valve overlapping the cycle of operation of the valve immediately preceding the one that is being activated.

SUMMARY OF THE INVENTION

In general, the objects and purposes of the invention are met by providing a device for elevating a pressure acting on a liquid which includes a liquid pressure elevating means for receiving liquid under a first positive pressure and at a selected volume of liquid per unit of time flow rate from a liquid source connected to an inlet port and delivering the liquid under a second positive pressure substantially greater than the first pressure and at the selected volume of liquid per unit of time flow rate to an outlet port and a liquid utilizing load connected thereto. The second pressure is sufficiently high enough to cause the liquid to become substantially compressed to a factor greater than the extent to which the liquid is compressed at the inlet port to thereby cause the second pressure to want to vary during intervals of time that the liquid is being compressed. A control mechanism is provided for accommodating the differential in the compressibility of the liquid at the inlet and the outlet so as to maintain a substantially constant second pressure at the selected flow rate.

BRIEF DESCRIPTION OF THE DRAWINGS

Further objects and purposes of this invention will be apparent to persons acquainted with apparatus of this general type upon reading the following specification and inspecting the accompanying drawings, in which.

DETAIL DESCRIPTION

Figure 1:
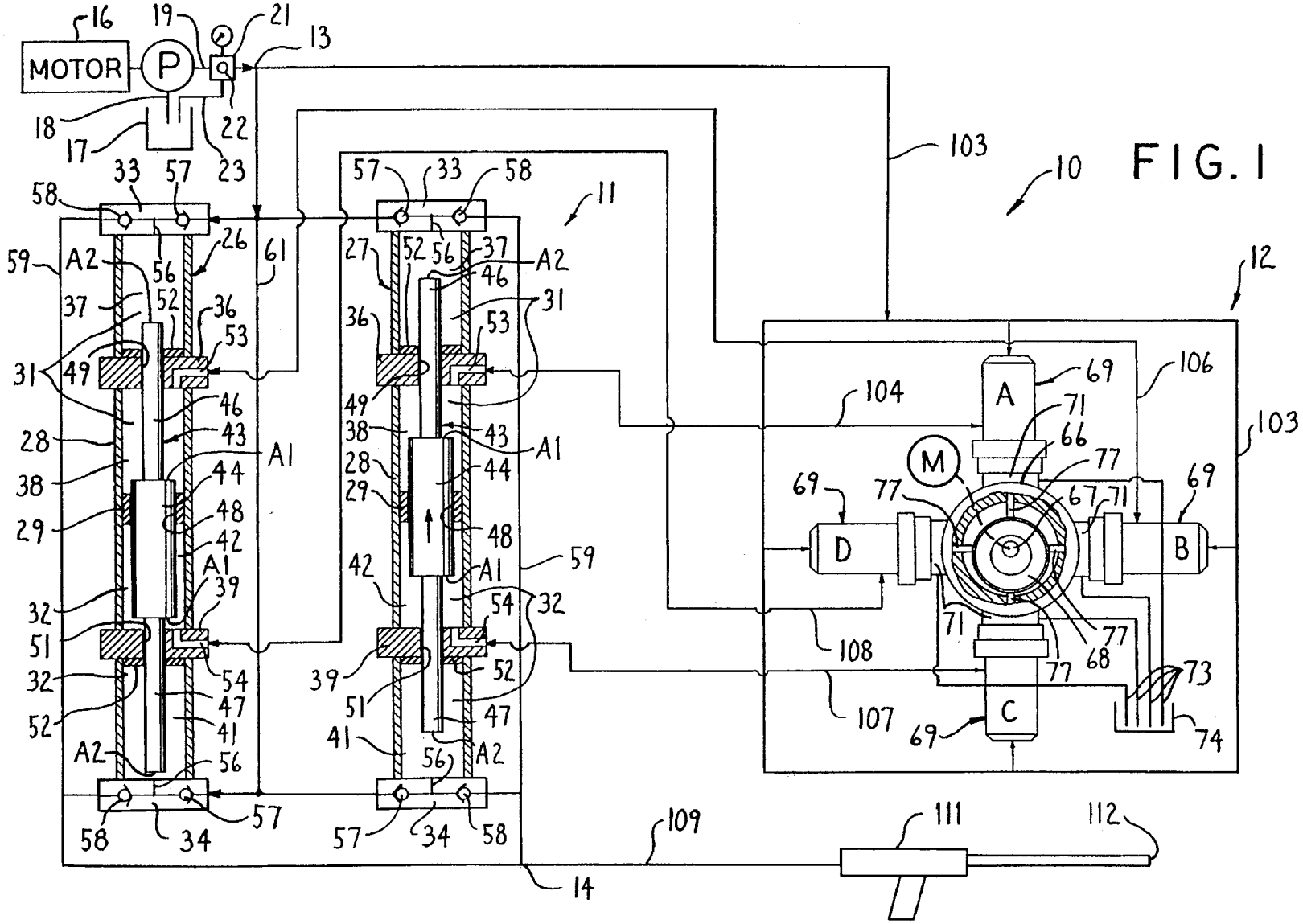
FIG. 1 is a liquid circuit schematic diagram of a device for elevating a pressure acting on a liquid and embodying the invention.

FIG. 1 illustrates a device 10 embodying the invention for elevating a pressure acting on a liquid. The device 10 includes a liquid pressure elevating mechanism 11 and a control mechanism 12 for accommodating the difference in degree of compressibility of the liquid adjacent the inlet to the liquid pressure elevating mechanism and the liquid adjacent the outlet of the liquid pressure elevation mechanism so as to effect a maintaining of the pressure at the outlet from the liquid pressure elevating mechanism substantially constant.

More specifically, the liquid elevation mechanism 11 includes an inlet port 13 as well as an outlet port 14. A pump P driven by a motor 16 removes liquid from a reservoir 17 through a suction port 18 and delivers pressurized liquid to an outlet port 19 thereof. A pressure relief valve 21 is provided for regulating the magnitude of the pressure on the liquid supplied to the inlet port 13 of the liquid pressure elevating mechanism 11. A control knob 22 is provided for facilitating a manual control of the magnitude of the liquid pressure provided to the inlet port 13. A return line 23 is provided between the pressure relief valve 21 and the reservoir 17. In this particular embodiment, the pump P is adapted to provide liquid at a pressure of 10,000 psi to the inlet port 13.

The liquid pressure elevation mechanism 11 includes, in this particular embodiment, a pair of elongated cylinder housings 26 and 27. The cylinder housings 26 and 27 are of identical construction and, therefore, the same reference numerals will be utilized to describe the component parts. The cylinder housings 26 and 27 each have an elongated cylindrical wall construction 28. The cylindrical wall construction 28 includes at the midpoint thereof a barrier wall 29 dividing the interior of the cylindrical wall construction 28 into first and second chambers 31 and 32, respectively, which chambers 31 and 32 are oriented between the barrier wall 29 and respective end caps 33 and 34. A further barrier wall 36 divides the chamber 31 into first and second subchambers 37 and 38, respectively. A still further barrier wall 39 divides the chamber 32 into first and second subchambers 41 and 42, respectively.

Each of the cylinder housings 26 and 27 has reciprocally oriented therein a plunger 43. Each plunger 43 includes an elongated main body portion 44 and a plunger rod 46 and 47 extending from a respective end of the elongated main body portion 44. The elongated main body portion 44 is sealingly slidingly supported in an opening 48 provided in the barrier wall 29. Each of the plunger rods 46 and 47 are sealingly slidingly guided through an opening 49 in the barrier wall 36 and 51 in the barrier wall 39. Appropriate packing 52 is provided in each of the first subchambers 37 and 41 so as to facilitate a sealing arrangement around the respective plunger rods 46 and 47 which extend into the respective first subchambers 37 and 41. A fluid inlet port 53 is provided in the barrier wall 36 and provides fluid communication to the second subchamber 38. Similarly, a liquid passageway 54 is provided in the barrier wall 39 so as to provide liquid communication to the second subchamber 42.

The end caps 33 and 34 are identical to each other and each include a passageway 56 communicating with a respective one of the first subchambers 37 and 41 of each of the cylinder housings 26 and 27. A one way check valve is provided between the passageway 56 and the inlet port 13 and allows liquid to flow only from the inlet port 13 to the passageway 56 and thence into the first subchambers 37 and 41. A check valve 58 is provided between the passageway 56 and the outlet port 14 and allows liquid flow only from the passageway 56 to the outlet port 14 through a passageway 59. As is apparent in FIG. 1, the inlet port 13 is connected through a passageway 61 to each of the check valves 57 and the outlet 14 is connected through the passageways 59 to each of the check valves 58.

The cross-sectional area A1 of the elongated main body portion 44 is four times the cross-sectional area A2 of the plunger rods 46 and 47.

Figure 2:
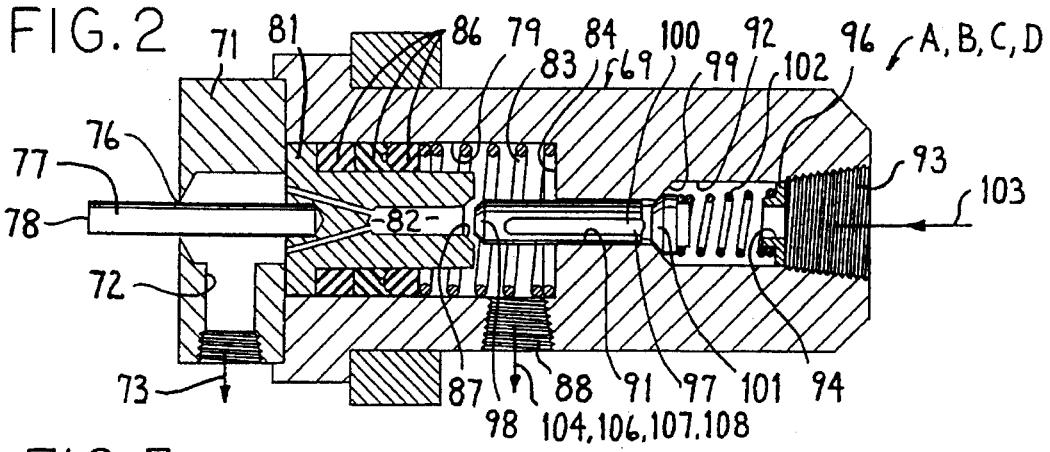
FIGS. 2–5 are each a longitudinal cross-sectional view of a liquid distribution valve in its sequential stages of operation.

The aforesaid cylinder housings 26 and 27 effect a liquid pressure elevation from the initial liquid pressure applied to the inlet port 13. In order to effect the liquid pressure elevation, the control mechanism 12 needs to be operated in conjunction with the liquid pressure elevation mechanism 11. Therefore, and referring to the control mechanism 12, it includes a frame 66 rotatably supporting a shaft 67 driven by a synchronous motor M. An eccentrically oriented circular cam 68 is affixed to the shaft 67 and rotates therewith. The frame 66 also includes a plurality of valves A, B, C and D secured to the periphery of the frame 66 and are separated from one another at 90° intervals about the axis of rotation of the shaft 67. FIG. 2 illustrates a longitudinal cross-sectional view of one of the valves, it being understood that valves A, B, C and D are each identical to one another.

Referring to FIG. 2, each valve A, B, C and D includes an elongated valve body 69 which includes an adapter plate 71 facilitating a mounting of the valve body 69 onto the frame 66 (FIG. 1). The adapter plate 71 includes a chamber 72 therein which communicates via a passageway 73 to a reservoir 74 at atmospheric pressure. The adapter plate 71 also includes a passageway 76 through which extends an elongated pin 77. The distal end of the pin 78 is adapted to engage the radially outwardly facing peripheral surface of the circular cam 68. The distal end 78 is maintained in engagement with the peripheral surface of the cam by a spring which will be described below.

The valve body 69 includes a cavity 79 therein, in which cavity is supported a reciprocal piston 81. A central passageway 82 extends through the piston 81 and provides communication through the piston 81 to the chamber 72. A spring 83 is supported at one end on the bottom wall 84 of the cavity 79 and at the other end on packing 86 which is provided between a reduced diameter portion of the piston 81 and the internal surface of the cavity 79. It is the spring 83 that urges the piston 81 and the pin 77 connected thereto and, particularly, the distal end 78 of the pin 77 into engagement with the peripheral surface of the cam 68. A first valve seat 87 encircles the passageway 82 at the end of the piston 81 remote from the pin 77. In addition, an outlet port 88 communicates with the cavity 79.

The valve body 69 also includes a further passageway 91 extending through the bottom wall 84 of the cavity 79 and into a further cavity 92. An inlet port 93 communicates with the cavity 92 through an opening 94 in a spring abutment 96 provided in the cavity 92. A pin 97 is supported for reciprocal movement in the passageway 91. One end of the pin 97 has a second valve seat 98 thereon having a surface that conforms to the surface of the first valve seat 87. When the first and second valve seats 87 and 98 are in engagement with one another, no liquid is allowed to flow therepast. A third valve seat 99 is provided on the valve body 69 and encircles the opening 91 at an end thereof remote from the bottom wall 84 of the cavity 79. Similarly, the end of the pin 91 remote from the second valve seat 98 has a fourth valve seat 101 thereon having a surface opposing the third valve seat 99 and conforming to the surface of the third valve seat 99. The pin 97 has an elongated channel 100 therein which extends from the proximity of the fourth valve seat 101 along the length of the pin 97 and into the cavity 79. A spring 102 extends between the spring abutment 96 and an end of the pin 91 adjacent the fourth valve seat 98 so as to urge the fourth valve seat 101 toward the third valve seat 99.

Referring now to FIG. 1, the inlet port 13 is connected via a passageway 103 to the inlet port 93 of each of the valves A, B, C and D. The outlet port 88 of each of the valves is connected through a passageway to a selected one of the inlet ports on the cylindrical housings 26 and 27. More specifically, the outlet port 88 on the valve A is connected through a passageway 104 to the inlet port 53 on the cylindrical housing 27. The outlet port 88 on the valve B is connected through a passageway 106 to the inlet port 53 on the valve housing 26. The outlet port 88 of the valve C is connected through a passageway 107 to the inlet port 54 on the cylindrical housing 27 and the outlet port 88 on the valve D is connected through a passageway 108 to the inlet port 54 on the valve housing 26.

Lastly, the outlet port 14 is connected through a conduit 109, here a flexible hose, to a liquid utilizing load 111, here a water spray jet gun 111. The gun 111 has a trigger mechanism which, when activated, allows liquid to pass from the conduit 109 out through an outlet 112.

OPERATION

Although the operation of the device embodying the invention has been indicated somewhat above, the operation will be described in detail below to assure a more complete understanding of the invention.

Figure 4:
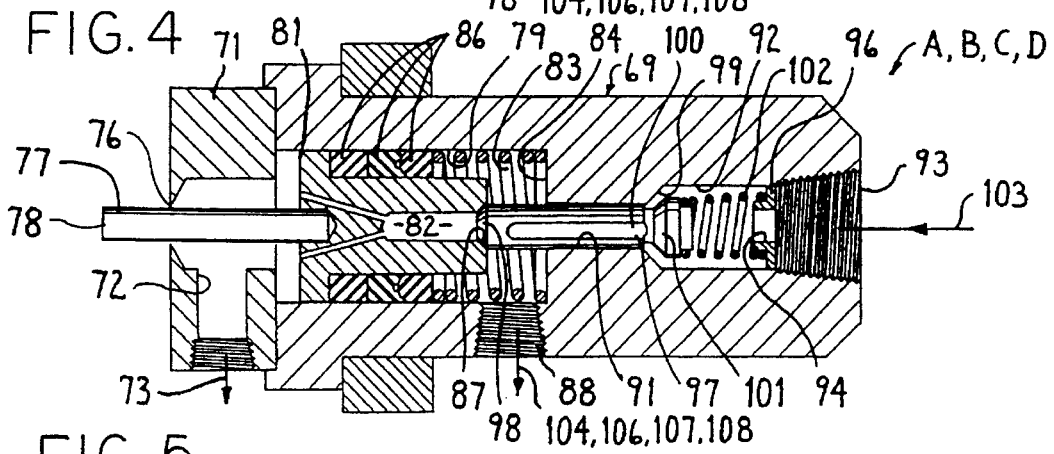

With the pump P in the inactive state, that is, the motor 16 is not energized, the motor M is activated to drive the shaft 67 and the cam 68 thereon for rotation. As a result, the pin 77 in each of the valves A, B, C and D will be sequentially activated by reason of the high point of the cam 68 moving past each of the pins 77. In this particular embodiment, the circular cam 68 is eccentrically oriented relative to the axis of rotation of the shaft 67. The high point of the cam illustrated in FIG. 1 is at the pin 77 for the valve C. Similarly, the low point of the cam is at the pin 77 of the valve A. Once the motor M has been activated and the shaft 67 is rotating, the motor 16 is activated to energize the pump P to provide pressurized liquid at the outlet 19 thereof. With the trigger on the gun 111 activated to allow liquid to exit the outlet 112, liquid will pass through the pressure relief valve 21 and to the inlet port 13 and through the passageway 103 into the inlet port 93 of, for example, the valve C. The valve C is already at the high point of the cam as shown in FIG. 1, namely, a position corresponding to FIG. 4. Thus, liquid will enter the inlet 93 and move through the cavity 92 and past the now open valve defined by the spaced apart third and fourth valve seats 99 and 101 and thence along the channel 100 into the cavity 79. Since the first and second valve seats 87 and 98 are now closed by reason of the cam 98 having urged the pin 77 and piston 81 connected thereto to the right in FIG. 4 so as to cause the seats 87 and 98 to engage, liquid will pass out through the outlet 88 through the passageway 107 to the inlet port 54 of the cylindrical housing 27. At this particular moment, it will be noted that valve A is oriented at the low point of the cam 68, namely, a position corresponding to FIG. 2 wherein a space exists between the first and second valve seats 87 and 98 so as to cause liquid that may be present in the second subchamber 38 to move out through the passageway 53 into the passageway 104 and thence through the port 88, past the spaced apart first and second valve seats 87 and 98, through the passageway 82 and into the cavity 72 which in turn is connected through the passageway 73 to the reservoir 74. Thus, liquid entering the second subchamber 42 through the passageways 54 and 107 will drive the plunger 43 from its initial position wherein the distal end of the piston rod 47 is closely adjacent the end wall 34 toward the other end of its stroke wherein the distal end of the piston rod 46 becomes located adjacent the end wall 33. In the position illustrated in FIG. 1, the plunger 43 has travelled approximately half of its total stroke length since the cam 68 is half way through its cycle of operation on the valves A and C.

The total cross-sectional area A2 of the distal end of the piston rod 47 plus the cross-sectional area of the exposed surface of the elongated main body portion 44 at the juncture between the piston rod 47 and the elongated main body portion 44 (area A1) is four times greater than the cross-sectional area A2 at the distal end of the piston rod 46. As a result, the plunger 43 of the cylinder housing 27 will be moved in the direction of the arrow and the pressure on the liquid in the first subchamber 37 will be four times greater than the pressure on the liquid in the first subchamber 41, namely, it will be at 40,000 psi. The 40,000 psi liquid in the first subchamber 37 will be discharged through the check valve 58 into the passageway 59 and thence through the outlet port 14 to the liquid utilizing load 111.

Figure 3:
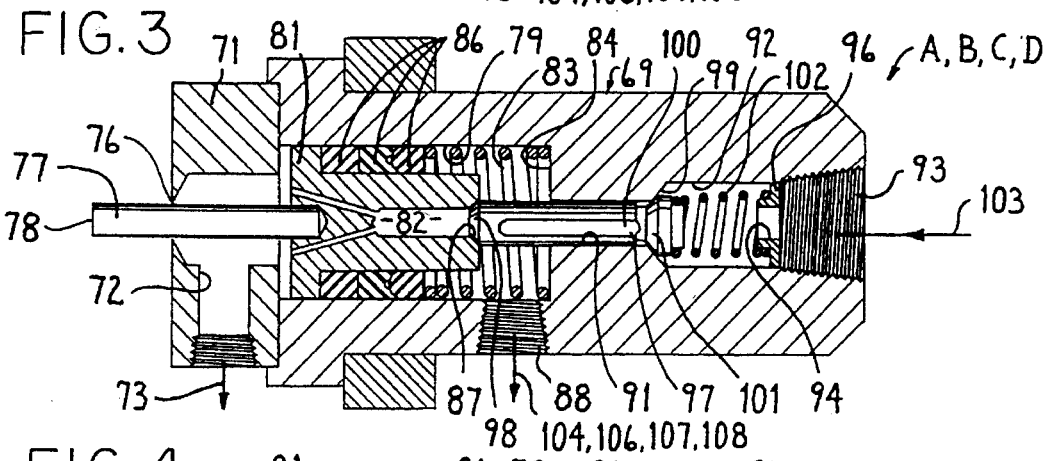
Figure 5:
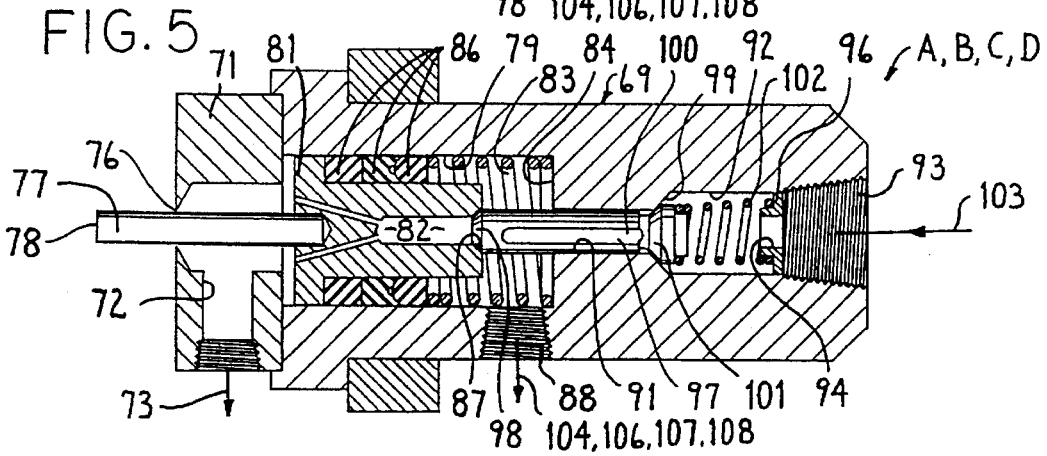
Figure 6:
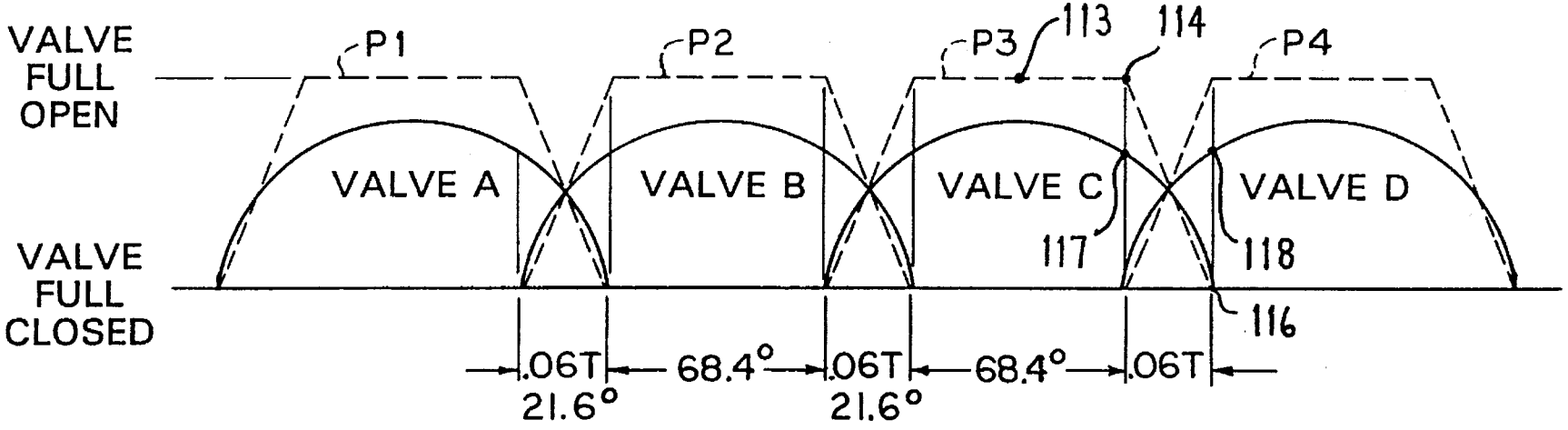
FIG. 6 is a graph illustrating valve operation and plunger movement during a cycle of operation of the device.
Figure 7:
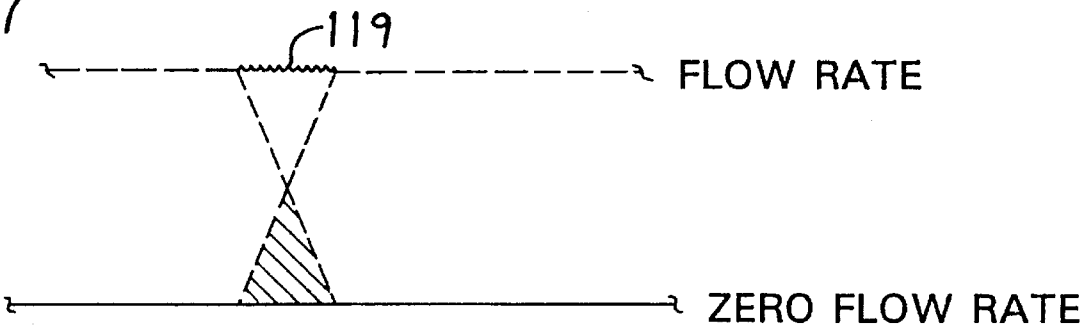
FIG. 7 is a graphical illustration of the flow rate during a transition between the end of a cycle of operation of one valve and the beginning cycle of operation of the next operable valve.

Referring to FIG. 6, the plunger 43 in the cylinder housing 27 and its respective movement is identified by the broken line P3 and the position of its travel in time T is identified by reference numeral 113. That is, the position 113 on the line P3 corresponds to the location of the plunger 43 in the cylinder housing 27 in FIG. 1. As the plunger 43 in the cylinder housing 27 nears the end of its stroke, and the distal end of the piston rod 46 approaches the end wall 33, the position 114 in FIG. 6 is reached. At this particular moment in time, the valve C finishes its movement between the FIG. 4 position and the FIG. 5 position, the FIG. 5 position corresponding to point 116 in FIG. 6. Simultaneous with the cam 68 arriving at point 117, valve D, which is initially in the FIG. 2 position, will be moved first to the FIG. 3 position and thence to the FIG. 4 position which corresponds to point 118 in FIG. 6. At this particular moment in time, liquid will enter the inlet 93 of the valve D from the passageway 103, pass through the spacing between the third and fourth valve seats 99 and 101, thence through the channel 100 into the cavity 79 and thence out through the outlet 88 and passageway 108 to the inlet passageway 54 in the cylinder housing 26. It is to be noted that valve C is in the process of closing, namely, moving from the FIG. 4 position through the FIG. 5 position into the FIG. 2 position (corresponding to point 116) at the same time that valve D is moving from the FIG. 3 position into the FIG. 4 position (corresponding to a movement from point 115 to point 118). If the liquid utilizing load 111 is open and liquid is spraying out through the outlet 112 at 40,000 psi, the flow through the valve C will be diminishing by reason of a movement of the valve from the FIG. 4 (point 114) position to the FIG. 5 (just prior to point 116 being reached) position while at the same time liquid is being dispensed through the liquid utilizing load 111 to normally cause the pressure at the outlet 114 to want to drop significantly. However, in view of valve D being activated before valve C reaches the FIG. 5 position, namely, it moves from the FIG. 3 (point 115) position toward the FIG. 4 (point 118) position while valve C is moving from the FIG. 4 position to the FIG. 5 position, the plunger 43 in the cylinder housing 26 begins to move from its initial position shown in FIG. 1 toward the opposite end of the cylinder housing 28. As a result, and referring to FIG. 7, the cross hatched quantity of liquid is exiting from both of the first subchambers 37 in both of the cylinder housings 26 and 27 through the respective check valves 58 into the passageways 59 and thence to the outlet 14. The double quantities of liquid are added together so as to maintain a substantially constant flow rate as at 119 to maintain the pressure constant at the outlet port 14. In other words, by activating the plunger 43 and the cylinder housing 26 at a time interval before the plunger 43 in the cylinder housing 27 reaches the end of its stroke, the plunger 43 in the cylinder housing 26 can effect a compressing of the liquid in the first subchamber 37 until the desired magnitude of pressure, here 40,000 psi, is achieved and before the pressure in the first subchamber 37 in the cylinder housing 27 diminishes to zero. As a result, the flow of liquid from both of the first subchambers 37 enable the substantially high pressure at the outlet port 14 to be maintained without the need for any accumulator circuitry in the liquid circuit.

I have discovered that the amount of overlap in the operation of a pair of mutually sequential valves to achieve at 40,000 psi operation of the liquid elevation mechanism 11 is 6% of a 360° cycle or 21.6° of the circular cam 68 as depicted in FIG. 6.

It is to be understood that if the liquid utilizing load 111 is suddenly turned off, there will be no need to dump the pressurized liquid at the outlet 14. The liquid trying to enter the inlet port 13 will have no place to go and will be dumped by the relief valve 21 back into the reservoir 17 through the return line 23.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for elevating a pressure acting on a liquid, comprising:

a first pressure elevating means for supplying a liquid under a first positive pressure and at a selected volume of liquid per unit of time flow rate to a liquid inlet port;

a second liquid pressure elevating means for receiving the liquid under the first positive pressure and at the selected volume of liquid per unit of time flow rate from the inlet port and supplying the liquid under a second positive pressure substantially greater than the first pressure and at said selected volume of liquid per unit of time flow rate to an outlet port and a liquid utilizing load connected thereto, said second pressure being sufficiently high enough to cause the liquid to become substantially compressed to thereby result in said second pressure to vary during intervals of time that the liquid is being compressed; and control means for accommodating the compressibility of the liquid so as to maintain a substantially constant second pressure.

2. The device according to claim 1, wherein said second liquid pressure elevating means includes at least a pair of elongated, hollow, cylinder housings each having a piston means reciprocally movably oriented therein, first inlet means for introducing the liquid at said first positive pressure and a selected flow rate into a first of said pair of said hollow cylinder housings on a first side of said piston means, a second inlet means for introducing the liquid at said first positive pressure into said first hollow cylinder housing on a second side of said piston means remote from said first side, a first outlet means for allowing the liquid to exit said second side, said piston means including a liquid compressing means on said second side thereof operative in response to a movement of said piston means during intervals of time that the liquid is being compressed, said second of said pair of cylinder housings being identical to said first cylinder housing, said first outlet means on said first and second cylinder housings being joined together to form a common outlet; and wherein said control means includes means for effecting a pressure imbalance on one side of said piston means in said second cylinder housing before said piston means in said first cylinder housing arrives at an end of a stroke path therefor and whereat said flow rate therefrom begins to diminish so that a flow rate caused by a beginning stroke path of said piston means in said second cylinder housing will supply a flow rate balancing amount of the liquid to said common outlet and at substantially the same second pressure so as to maintain substantially constant the second pressure at said common outlet.

3. A device for elevating a pressure acting on a liquid, comprising:

liquid pressure elevating means for receiving liquid under a first positive pressure and at a selected volume of liquid per unit of time flow rate from a liquid source at an inlet port and supplying the liquid under a second positive pressure substantially greater than the first pressure and at said selected volume of liquid per unit of time flow rate to an outlet port and a liquid utilizing load connected thereto, said second pressure being sufficiently high enough to cause the liquid to become substantially compressed to thereby result in said second pressure to vary during intervals of time that the liquid is being compressed;

control means for accommodating the compressibility of the liquid so as to maintain a substantially constant second pressure;

wherein said liquid pressure elevating means includes at least a pair of elongated, hollow, cylinder housings each having a piston means reciprocally movably oriented therein, first inlet means for introducing liquid at said first positive pressure and a selected flow rate into a first of said pair of said hollow cylinder housings on a first side of said piston means, a second inlet means for introducing liquid at said first positive pressure into said first hollow cylinder housing on a second side of said piston means remote from said first side, a first outlet means for allowing the liquid to exit said second side, said piston means including a liquid compressing means on said second side thereof operative in response to a movement of said piston means during intervals of time that the liquid is being compressed, said second of said pair of cylinder housings being identical to said first cylinder housing, said first outlet means on said first and second cylinder housings being joined together to form a common outlet; and wherein said control means includes means for effecting a pressure imbalance on one side of said piston means in said second cylinder housing before said piston means in said first cylinder housing arrives at an end of a stroke path therefor and whereat said flow rate therefrom begins to diminish so that a flow rate caused by a beginning stroke path of said piston means in said second cylinder housing will supply a flow rate balancing amount of liquid to said common outlet and at substantially the same second pressure so as to maintain substantially constant the second pressure at said common outlet.

4. A device for receiving liquid under a first pressure from a liquid source supplied to a first inlet port thereon and supplying liquid under a second pressure greater than the first pressure to a first outlet port thereon and a liquid utilizing object connected thereto, comprising:

at least a pair of elongated cylinder housings each having a pair of spaced end walls and a reciprocal plunger provided inside said cylinder housing, each plunger having an elongated body of a first cross-sectional area and an elongated rod extending axially from each end of said body, each rod being of a second cross-sectional area smaller than said first cross-sectional area, each said elongated cylinder housing having a first barrier wall adjacent a midlength part of each said elongated cylinder housing to divide each said elongated cylinder housing into first and second chambers, first means defining a first opening through each said first barrier wall and slidably and sealingly engaging a respective said elongated body as said respective said body of each said plunger is reciprocated in each said elongated cylinder housing, each said first and second chamber having a second barrier wall located intermediate said first barrier wall and a respective one of said end walls so as to divide each said first and said second chambers into first and second subchambers, second means defining a second opening through each said second barrier wall and slidably and sealingly engaging a respective said rod as each said plunger is reciprocated in each said elongated cylinder housing;

first check valve means operatively connected in fluid circuit with said first inlet port and each said first subchamber for solely directing a flow of liquid entering said first inlet port into each said first subchambers;

second check valve means operatively connected in fluid circuit with said first outlet port and each said first subchamber for solely directing a flow of liquid out of each said first subchambers to said first outlet port;

passageway means and connection means therefor for providing a separate liquid passageway to each said second subchamber;

distributor means having plural openable and closeable distributor valves, each said distributor valve having a second inlet port connected in liquid circuit with said first inlet port and a second outlet port, each said second outlet port being connected in liquid circuit to a respective one of said separate liquid passageways; and control means for serially opening and then closing each said distributor valve so that liquid supplied to said first inlet port at said first pressure is allowed to flow sequentially through each said distributor valve and to a respective one of said second subchambers so as to effect an urging of a respective said plunger from a first end of its respective stroke toward a second end thereof, the liquid under said first pressure entering said first subchamber at said first end direct from said first inlet port and entering said respective one of said second subchambers direct from said distributor valve acting on a sum of said first and second cross-sectional areas on a common side of said plunger and said rod so as to drive said plunger toward said second end so that said rod at another end of said plunger places a second pressure on the liquid in said first subchamber adjacent said second end of the stroke of said plunger that is greater than said first pressure supplied to said first inlet port by an amount that said sum is greater than said second cross-sectional area.

5. The device according to claim 4, wherein each said distributor valve includes a housing having a first valve seat and a movable valve member supported for movement in said housing between first and second positions, said movable valve member having a second valve seat thereon, said first and second valve seats being sealingly engaged when said movable valve member is in said first position and separated from one another when said movable valve member is in said second position; and wherein said movable valve member is continuously urged to said first position by the liquid under said first pressure supplied to said first inlet port.

6. The device according to claim 5, wherein said distributor valve includes a rotatable cam periodically and serially engageable with each said movable valve member to urge each said movable valve member toward said second position and said second seat thereon away from said first seat so as to allow liquid to flow past said separated first and second valve seats.

7. The device according to claim 6, wherein said movable valve member has a third valve seat thereon spaced from said second valve seat;

wherein said housing of said distributor valve has a cavity therein in which is slidably and sealingly supported a piston member having means defining a passageway extending therethrough, one end of said passageway terminating in a fourth valve seat opposing said third valve seat;

wherein a yieldable spring means is provided in said cavity for urging said piston member and said fourth valve seat away from said third valve seat so that said third and fourth valve seats will be separated when said first and second valve seats are sealingly engaged;

wherein a means defining a passageway in said housing of said distributor valve is provided for connecting said cavity on a side of said piston member remote from said fourth valve seat in liquid circuit with a connection adapted to be connected to a return line to a liquid reservoir, said second outlet port being connected in liquid circuit to said cavity on a side of said piston member common to said fourth valve seat; and wherein said piston member includes a piston rod adapted to be engaged by said rotatable cam at least once for each 360° rotation thereof to move said piston member and said fourth valve seat thereon against the urging of said yieldable spring means first into a sealing engaging relation with said third valve seat so as to close off the possibility of liquid flow from said cavity on a side of said piston member common to said fourth valve seat to said connection to the return line to the liquid reservoir, followed by a continued movement of said piston member and said movable valve member therewith against the continued urging of said yieldable spring means toward said second position of said movable valve member so as to allow liquid to flow past said separated first and second valve seats to said second outlet port.

8. The device according to claim 6, wherein said rotatable cam is a flat disk the perimeter of which is circular in shape and is rotatable about an axis of rotation offset from a center of said disk.

9. The device according to claim 4, wherein a ratio of said first cross-sectional area to said second cross-sectional area is 4:1.

* * * * *